United States Patent [19]

Müeller

[11] 3,998,082

[45] Dec. 21, 1976

[54] DEVICE FOR THE MANUFACTURE OF HELICALLY CORRUGATED TUBES

[75] Inventor: Kurt Müeller, Hannover, Germany

[73] Assignee: Kabel-Und Metallwerke Gutehoffnungshuette AG, Hannover, Germany

[22] Filed: Feb. 20, 1975

[21] Appl. No.: 551,308

[52] U.S. Cl. ..... 72/77

[51] Int. Cl.[2] ..... B21D 15/06

[58] Field of Search ..... 72/77, 114, 121, 120, 72/112, 103, 80

[56] References Cited

UNITED STATES PATENTS

| | | | |
|---|---|---|---|
| 3,208,256 | 9/1965 | Lehnert | 72/77 |

FOREIGN PATENTS OR APPLICATIONS

| | | | |
|---|---|---|---|
| 585,377 | 10/1959 | Canada | 72/77 |
| 1,936,894 | 7/1969 | Germany | 72/77 |

*Primary Examiner*—Milton S. Mehr
*Attorney, Agent, or Firm*—Marn & Jangarathis

[57] ABSTRACT

A corrugating tool in the form of a segment, having a helically shaped forming edge, whereby the tool is in contact with less than the entire circumference of a tube to be corrugated. The tool is pivotably mounted to the corrugating head to permit adjustment of the corrugating depth.

4 Claims, 2 Drawing Figures

DEVICE FOR THE MANUFACTURE OF HELICALLY CORRUGATED TUBES

This invention relates to the production of corrugated tubes, and more particularly, to the production of helically corrugated tubes.

A device for making helically shaped corrugated pipes is known wherein a corrugating tool having a thread is mounted on a smooth pipe and the pipe then provided with a helically shaped corrugation; e.g., German Pat. No. 690,138. The finished corrugated pipes which are made in this fashion have a very even corrugation; however, the disadvantage of such a tool is that the tool becomes very hot during the manufacturing operation. In addition, the depth of the corruguation is defined by the corrugation tool and the outer diameter of the smooth pipe to be corrugated.

The principle object of the present invention is to provide for an improved device for producing a helically corrugated tube.

In accordance with the present invention, there is provided a corrugating device which includes a tool for effecting a helical corrugation having a helically shaped forming edge which engages the wall of the tube to be corrugated over less than the full circumference of the tube. As a result of the contact being over less than the full circumference of the tube being corrugated, the corrugating tool does not become excessively hot.

In accordance with a particularly preferred embodiment, the corrugating tool, in the form of a segment having a helical forming edge which edges less than the full circumference of the pipe being corrugated, is mounted in the corrugating device in a manner such that the depth of the corrugation produced by the tool can be changed. In accordance with the preferred aspect, the tool is pivotably mounted about an axis outside of the pipe axis for increasing and decreasing the depth of the corrugation and there is provided a means for changing and maintaining the position of the tool with respect to the tube to change the depth of the corrugation.

In accordance with a particularly preferred feature, the curvature of the forming edge of the corrugating tool is about equal to the curvature of the smooth tube. In addition, it is particularly preferred to provide a corrugating tool in which the height of the forming edge decreases at the ends. In this manner, the beginning of the tube to be corrugated is engaged by the tool to provide a particularly even and flawless corrugation.

Figure 1:
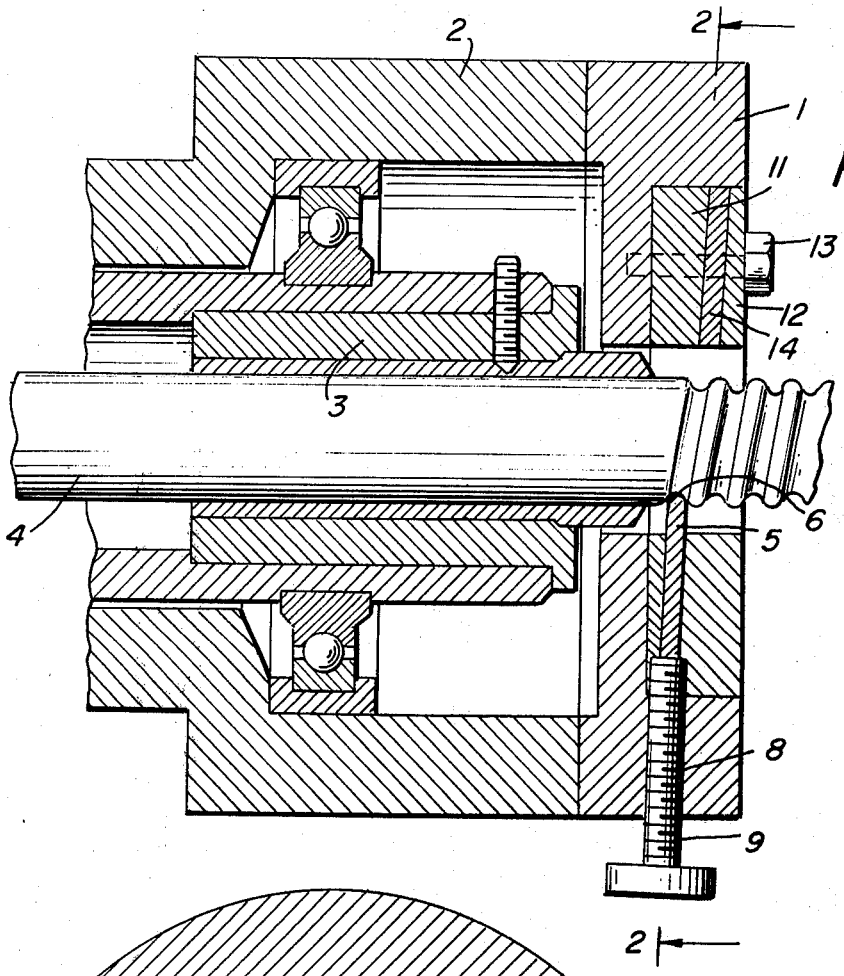
Figure 2:
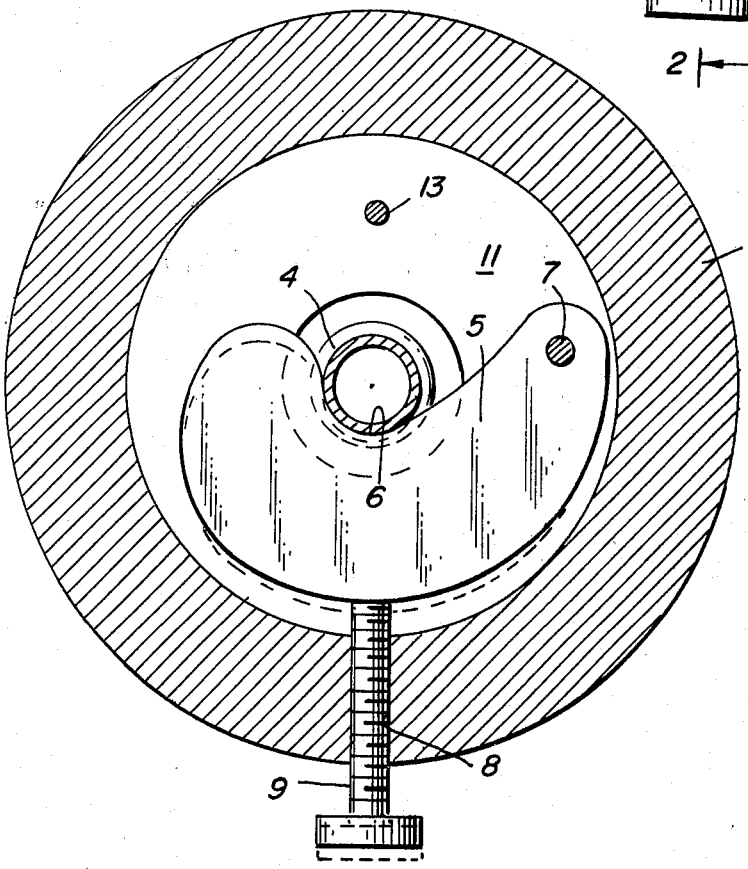

The invention will be further described with respect to the accompanying drawings, wherein:

FIG. 1 is a sectional view of an embodiment of the corrugator of the present invention; and FIG. 2 is an enlarged sectional view along the dotted line of FIG. 1.

Referring to the drawings there is shown, a corrugator including a corrugating head 1 which is driven by a suitble drive means (not shown) through a pipe bushing 2 which is rotatably mounted on a stationary guide bushing 3. The guide bushing 3 guides and supports a tube to be corrugated, in the form of a pipe 4; e.g., a smooth walled longitudinally welded pipe.

A corrugating tool 5, in the form of a segment, includes a helical forming edge 6. The disc segment is designed in a manner such that the forming edge 6 is in contact with about one-half of the circumference of the pipe 4.

The tool 5 is mounted in a recess in the corrugating head 1 by a suitable support in the form of discs 11 and 12, which are adapted and shaped to clamp the corrugating tool 5 therebetween, with the discs 11 and 12 being mounted to the corrugating head 1 by suitable fastening means, such as screws 13. A separate and distinct distance spacer 14 is also clamped between the discs 11 and 12, and the faces of discs 11 and 12, adjacent to the tool 5 and spacer 14, are adjusted to accomodate the tool 5 and spacer 14; i.e., the thickness of the discs 11 and 12 changes in the circumferential direction. Thus, in effect the tool 5 and distance spacer 14 form a helically shaped disc, with the tool portion or segment 5 of the disc providing the helical corrugation.

The tool 5 is pivotably mounted with respect to the head 1 by a bolt 7, which is mounted to the face of discs 11 and 12, and passes through a suitable bore in the tool 5, whereby the tool 5 is pivotable around bolt 7. The depth of the corrugation may be adjusted by pivoting tool 5 around bolt 7 towards and away from the pipe 4 by a means for changing and maintaining the position of the tool 5 in the form of an adjusting screw 9, which is provided in a bore 8 of corrugating head 1. Thus, prior to each operation, the depth of the corrugation can be adjusted by adjustment of screw 9.

The present invention is particularly advantageous in that overheating of the tool is avoided, and the depth of the corrugation can easily be changed.

The helically corrugated pipes made with the tool of the present invention can be used for a wide variety of purposes, and are particularly suitable for use as inner and outer conductors in high frequency cables.

Numerous modifications and variations of the present invention are possible in light of the above teachings and, therefore, within the scope of the appended claims, the invention may be practiced otherwise than as particularly described.

What is claimed is:

1. A corrugator, comprising:

a driven rotatable corrugating head;

a corrugating tool having a helically shaped forming edge, said corrugating tool being in the form of a segment whereby the forming edge of the tool is in contact with a tube to be corrugated over less than the circumference of the tube;

mounting means for directly mounting the corrugating tool to the corrugating head, said means including means for pivotally supporting the tool and clamping means for clamping the corrugating tool to the corrugating head;

means to change and maintain the position of the pivotally mounted corrugating tool with respect to the tube to adjust the depth of the corrugation, said means for changing and maintaining the position of the pivotally mounted corrugating tool maintaining the forming edge of the corrugating tool in contact with a tube during rotation of the corrugating head to produce a helical corrugation.

2. The corrugator of claim 1 wherein the curvature of the forming edge is equal to the curvature of a tube to be corrugated.

3. The corrugator of claim 1 wherein the height of the forming edge decreases at the end portion.

4. The corrugator of claim 1 wherein the corrugating tool is in the form of a segment which engages the tube over about half the circumference of the tube.

* * * * *

UNITED STATES PATENT OFFICE

CERTIFICATE OF CORRECTION

Patent No. 3,998,082 Dated December 21, 1976

Inventor(s) Kurt Mueller

It is certified that error appears in the above-identified patent and that said Letters Patent are hereby corrected as shown below:

Column 1, line 32, "edges" should be -- engages --.

Signed and Sealed this

First Day of March 1977

[SEAL]

*Attest:*

RUTH C. MASON
*Attesting Officer*

C. MARSHALL DANN
*Commissioner of Patents and Trademarks*